United States Patent [19]

Diez et al.

[11] 3,991,811

[45] Nov. 16, 1976

[54] PROCESS FOR MANUFACTURING A LIGHT ALLOY PISTON HAVING AN ANNULAR COOLING PASSAGE IN ITS HEAD PORTION

[75] Inventors: Adolf Diez, Bad Friedrichshall; Manfred Stark, Neckarsulm; Kurt Anderko, Heilbronn, all of Germany

[73] Assignee: Karl Schmidt GmbH, Neckarsulm, Germany

[22] Filed: Jan. 15, 1975

[21] Appl. No.: 541,319

[30] Foreign Application Priority Data

Jan. 18, 1974 Germany ..... 2402337

[52] U.S. Cl. ..... 164/121; 164/126; 164/128; 164/132; 164/340; 164/397; 164/DIG. 8

[51] Int. Cl.[2] ..... B22C 21/14; B22D 29/00; B22D 27/04

[58] Field of Search ..... 164/112, 126, 128, 334, 164/340, DIG. 8, 121, 132, 397

[56] References Cited

UNITED STATES PATENTS

| | | | |
|---|---|---|---|
| 851,993 | 4/1907 | Monnot | 164/334 |
| 1,103,039 | 7/1914 | Cudell | 164/340 X |
| 2,890,505 | 6/1959 | Brand | 164/334 X |
| 2,904,863 | 9/1959 | Schmid | 164/112 X |
| 3,459,253 | 8/1969 | Woolcott | 164/246 X |
| 3,763,926 | 10/1973 | Tschinkel et al. | 164/126 X |
| 3,764,575 | 10/1973 | Anderko et al. | 164/132 UX |

FOREIGN PATENTS OR APPLICATIONS

| | | | |
|---|---|---|---|
| 1,198,498 | 8/1965 | Germany | 164/126 |
| 187,256 | 10/1966 | U.S.S.R. | 164/340 |

*Primary Examiner*—Ronald J. Shore
*Attorney, Agent, or Firm*—Burgess, Dinklage & Sprung

[57] ABSTRACT

A light alloy piston having an annular cooling passage in its head portion is prepared by a process wherein a permanent mold, preferably having a steel shell and a water cooled bottom, is filled with the molten piston alloy. Thereafter, core elements, particularly a salt core for forming the cooling passage are introduced into the molten material by means of a holder and the permanent mold is held at an elevated temperature by external heating. The permanent mold is then lowered into a water bath for a given period of time. The soluble core, which has a specific gravity lower than that of the molten light alloy, is forced into the molten material to the desired position and depth using a holding device. The holding device is withdrawn from the remaining molten material when the solidification of the molten material has proceeded to the underside of the core. Preferably, the holding device is withdrawn during the lowering of the permanent mold into the water bath when the water level has reached the top level of the core.

4 Claims, 3 Drawing Figures

PROCESS FOR MANUFACTURING A LIGHT ALLOY PISTON HAVING AN ANNULAR COOLING PASSAGE IN ITS HEAD PORTION

BACKGROUND

This invention relates to a process of manufacturing a light alloy piston comprising an annular cooling passage in its head portion, in which a permanent mold, which preferably comprises a steel shell and which has a water-cooled bottom, is filled with the molten piston alloy, core elements, particularly a salt core for forming the cooling passage, are introduced into the molten material by means of a holder, and the permanent mold is held at an elevated temperature from the outside and is lowered into a water bath in accordance with a time program.

Cast pistons have an extremely wide field of application because the casting operation provides for a large latitude in design and because the alloy can be freely selected. In some cases, however, a pressed piston affords a higher protection against troubles which may arise in the operation of the engine. For this reason the use of pressed pistons is recommendable in racing engines, aircraft engines, engines having a large number of cylinders, and generally subjected to high mechanical and thermal stresses. Pressed pistons have a metallic structure which is dense and which in dependence on the degree of deformation is fine-grained even in thick cross-sections. The tensile strength, the yield point, the fatigue strength under repeated bending stresses, and the elongation at break are higher at temperatures between room temperature and about 250° C than with cast material. For this reason the adverse effects resulting from the use of an insufficiently large piston pin are not so strong and do not arise as soon as with a cast piston.

Pressed pistons are made from light alloys, which are usually cast as bar stock with direct water chilling. Discs having the desired weight are sawn off and are heated to about 500° C and then pressed to form a piston by means of a punch and die.

It is also known to make the piston blanks to be pressed in that a simple permanent mold, which preferably comprises a steel shell and which has a water-cooled bottom, is filled with a molten piston alloy, the molten material is held at an elevated temperature by gas burners directed to the chilled mold from the outside, and the mold is then lowered into a water bath in accordance with a time program. As a result, the solidification proceeds strictly from bottom to top at a predetermined velocity (Metallgesellschaft AG, Mitt. Arbeitsbereich N.F., No. 15, 1972, page 55).

Particularly in connection with relatively large pressed pistons in engines having a high power-to-weight ratio, long heat-conducting paths between the heat-receiving piston head and the ring area and the piston skirt result in excessively high temperatures at the piston head and in the ring area. This may give rise to incipient cracks or, depending on the design, to a coking of the oil or an excessively heavy wear in the annular grooves. Besides, large fluctuations of the clearances, with serious consequences, and a lower volumetric efficiency, resulting in a lower efficiency of the engine, must be expected. In such case an additional cooling of the piston with oil is essential.

An intense cooling may be effected with an annular cooling passage which is provided in the piston head and through which cooling oil is forced.

To provide such cooling passage, annular hollow cores of steel or copper or salt cores having a solid cross-section are inserted into the mold and are secured therein by means of retaining pins. After the blank consisting substantially of a solid cylinder has been cast and has then been hot-pressed to form a hollow piston, the hollow cores are dissolved out, e.g., with nitric acid, and the salt cores are flushed out with water when the inlet opening for the flow of cooling oil into the cooling passage has been formed by machining. Before the hot pressing to form the hollow piston, the pins which retain the cores are pulled out and the resulting holes are closed with cylindrical light alloy plugs (German Pat. No. 1,577,099) or with light alloy powder (Printed German Application 1,627,757). During the hot pressing of the hollow piston, the light alloy contained in the holes bonds to the piston material.

SUMMARY

This invention eliminates the use of retaining pins in the manufacture of a light alloy comprising an annular cooling passage formed in the piston head by means of a soluble core, such as a salt core, so that the expenditure is reduced which is due to the need to close the holes which are formed when the retaining pins are removed from the cast piston blank.

This is accomplished according to the invention in that the soluble core, which has a lower specific gravity than the molten light alloy, is forced by a holding device into the molten material to the desired position and depth, and the holding device is withdrawn from the remaining molten material when the solidification of the molten material has proceeded to the underside of the core.

According to a special feature of the invention, the holding device is withdrawn from the remaining molten material when the water level of the water bath into which the filled permanent mold is lowered has reached the top level of the core. A dislocation of the core is prevented because the molten material at the lowermost portion of the core has solidified in the meantime. As the solidification proceeds, the core is "frozen in" at the desired depth and in the desired orientation and no holding means remain in the solidified piston blank to be pressed.

DESCRIPTION

To prevent an evolution of gas from the core as it is immersed into the molten material, e.g., by an emergence of water vapor, the core is suitably heated to a temperature of 450°–600° C before it is immersed into the molten material.

Figure 1:
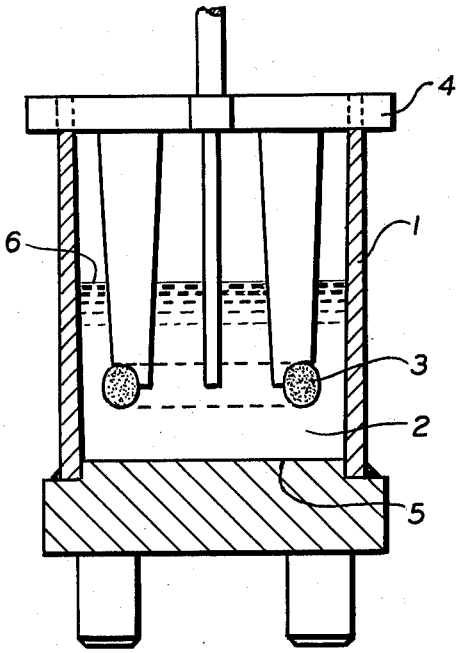
FIG. 1 is a vertical cross-sectional view of the mold wherein the core is immersed into molten metal by a cross-shaped holder.
Figure 3:
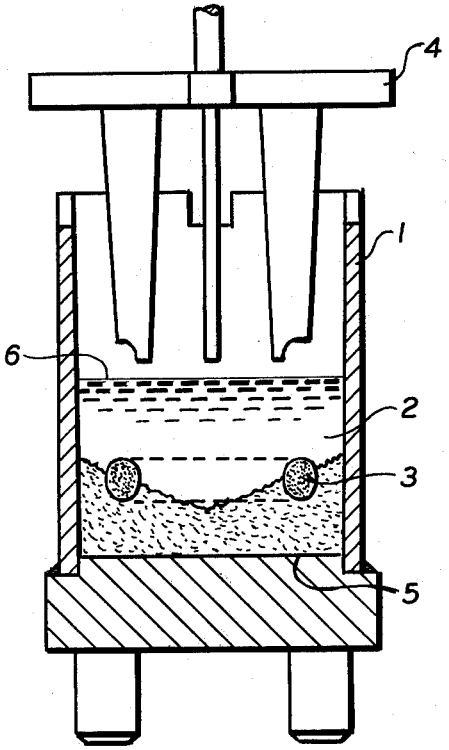
FIG. 3 is a vertical cross-sectional view of the mold of FIG. 1 showing the molten material solidified in the lowermost portion of the core and the holder withdrawn from the core.
Figure 2:
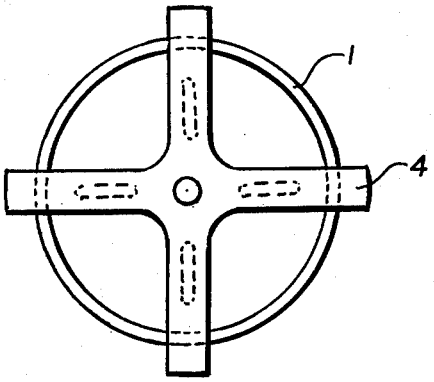
FIG. 2 is a top view of the mold and cross-shaped holder shown in FIG. 1.

The invention will now be explained more fully with reference to an example:

A permanent mold is used, which is 200 mm in diameter and comprises a steel shell 1. This mold is heated to a temperature of 540° C. A molten AlSi12CuNi piston alloy 2 at a temperature of 740±10° C is cast into said mold. The salt core 3 is heated to 550° C and by means of a cross-shaped holder 4 is immersed into the molten material 2 to the desired level. The permanent mold is heated from the outside with gas burners and is lowered at a velocity of 25–30 mm/min into a water bath to initiate the solidification, which proceeds from bottom 5 to top 6. The cross-shaped holder 4 is withdrawn as soon as the water level at the permanent mold has reached the top level of the salt core 3. A dislocation of the salt core is prevented because the solidification has proceeded to the bottom portion of the salt core 3.

The cast piston blank is then machined to the dimensions required for the pressing operation and the blank is then heated to a pressing temperature of about 500 ° C and is placed into the press tool, which has been heated to 320°–350 ° C.

The advantage which is afforded by the invention resides in that the manufacture of a pressed piston can be greatly simplified compared to the manufacture of a pressed piston according to the state of the art.

What is claimed is:

1. In a process for manufacturing a light alloy piston having an annular cooling passage in its head portion, wherein a permanent mold, preferably having a steel shell and a water-colored bottom, is filled with the molten piston alloy, core elements, particularly a salt core for forming the cooling passage, are introduced into the molten material by means of a holder, the permanent mold is held at an elevated temperature by external heating and is thereafter lowered into a water bath for a given time period, whereupon the alloy solidified, and the core is subsequently dissolved out of the solidified mass to leave the annular cooling passage, the improvement which comprises forcing the soluble core, which has a lower specific gravity than the molten light alloy, into the molten material to the desired position and depth by a holding device, and withdrawing the holding device from the remaining molten material while the mold is in the water bath when the solidification of the molten material has proceeded at least to the underside of the core.

2. Process of claim 1 wherein the holding device is withdrawn during the lowering of the permanent mold into the water bath when the water level has reached the top level of the core.

3. Process of claim 1 wherein the core is heated to a temperature of 500°–600° C before it enters the molten material.

4. Process of claim 1 wherein the permanent mold is heated to a temperature of 450°–600° C.

* * * * *